United States Patent [19]

Baldi et al.

[11] Patent Number: 4,778,304

[45] Date of Patent: Oct. 18, 1988

[54] PAVEMENT JOINT REWORKING APPARATUS

[75] Inventors: Barney T. Baldi, Eldorado Hills; John D. Ward, Roseville, both of Calif.

[73] Assignee: Diamond Tech, Inc., Roseville, Calif.

[21] Appl. No.: 46,374

[22] Filed: May 4, 1987

[51] Int. Cl.[4] ..... E01C 23/09

[52] U.S. Cl. ..... 404/87; 404/90; 299/38; 299/39; 125/14; 30/379; 83/928

[58] Field of Search ..... 404/87, 90, 93; 299/36, 299/38–40; 125/14; 83/928; 30/379, 379.5

[56] References Cited

U.S. PATENT DOCUMENTS

| | | | |
|---|---|---|---|
| 281,751 | 7/1883 | Church | 299/39 X |
| 1,063,527 | 6/1913 | Gaul | 299/39 X |
| 1,731,872 | 10/1929 | Schons | 299/39 X |
| 1,736,538 | 11/1929 | Kurtz | 299/39 X |
| 3,020,812 | 2/1962 | Gross | 299/39 X |
| 3,357,745 | 12/1967 | Cooper | 299/39 |
| 3,663,060 | 5/1972 | Shatwell et al. | 30/379 X |
| 4,236,356 | 12/1980 | Ward | 125/14 X |
| 4,456,303 | 6/1984 | Due | 125/14 X |

FOREIGN PATENT DOCUMENTS

| | | | |
|---|---|---|---|
| 142277 | 5/1985 | European Pat. Off. | 299/39 |
| 648678 | 2/1979 | U.S.S.R. | 299/40 |

OTHER PUBLICATIONS

Diamond Tech Inc. brochure, published in 1986.

*Primary Examiner*—Jerome Massie IV
*Assistant Examiner*—John F. Letchford
*Attorney, Agent, or Firm*—Townsend and Townsend

[57] ABSTRACT

Apparatus for reworking pavement expansion joints by resizing the joint includes a frame having front and rear portions hinged to one another at a transverse pivot axis. The frame pushed along the pavement by a vehicle. The rear frame portion is supported by laterally positioned wheels and by a rear guide disk. The front frame portion is supported by a front guide disk. The guide disks lie along the frame axis and engage the expansion joint to guide the frame along the joint. A concrete cutting saw is mounted to the rear frame portion directly above the axis of the support wheels with its saw blade lying in the same vertical plane as the guide disks. The saw is preferably remotely raised and lowerd through actuation of a hydraulic cylinder mounted to the frame to adjust the depth of cut. The frame is pushed through a link drive having dual axis joints for attachment to the vehicle and the frame.

22 Claims, 3 Drawing Sheets

PAVEMENT JOINT REWORKING APPARATUS

BACKGROUND OF THE INVENTION

Many large expanses of concrete. as well as some other paving materials, have periodic expansion joints . the joints usually being filled with a resilient material. At times the expansion joints must be reworked by removing and replacing the joint material. In some situations, depending upon the type of joint filler material used. the joint must be reworked, typically widened, prior to installing the new joint material. Conventional saws do not commonly create a finished joint having the uniform width and smooth cut surfaces required for some joint materials.

SUMMARY OF THE INVENTION

The present invention is directed to pavement joint reworking apparatus used to enlarge pavement expansion joints such as when replacing joint material. The apparatus is best suited for essentially straight joint segments in substantially flat (horizontal or sloped) pavement surfaces. The apparatus can also be used for joints which extend between surfaces which are at an angle to one another.

The apparatus includes a sawhead assembly pushed along the pavement by a vehicle. The sawhead assembly includes a sawhead and a link drive coupling the sawhead and the vehicle. The sawhead assembly frame is supported on the pavement by support wheels. Front and rear guide disks mounted to the front and rear ends of the frame. The guide disks lie in a vertical plane passing through the longitudinal axis of the frame. The guide disks are sized so that they track within the joint being reworked so to guide the sawhead directly over the joint.

A pavement cutting saw is mounted centrally to the frame so the saw blade also lies in the vertical plane. Thus, when the two guide disks engage a joint, the saw blade, lying in the same vertical plane, is vertically aligned with the joint. The saw, in the preferred embodiment, is remotely raised and lowered through actuation of a hydraulic cylinder mounted to the frame. The depth of cut is adjusted by placing spacers between the frame and the saw.

Typically a set of saw blades separated by spacers are used rather than a single, wide saw blade. As used in this application, saw blade includes a set of saw blades as well.

The front portion of the frame is pivotally mounted to the rear portion for movement about a pivot axis perpendicular to the vertical plane. The saw and support wheels are mounted to the rear frame portion. Preferably the pivot axis is coaxial with the support wheels and is vertically aligned with the saw axis.

The sawhead is pushed (and sometimes pulled) along the pavement through a link drive. The link drive includes a link connected to the sawhead frame by a first dual axis joint and to the vehicle by a second dual axis joint.

One of the key features of the invention is the provision of the pivoted or articulated frame in which one portion, in the preferred embodiment the front portion, is freely liftable while the other supports the saw. This permits a freely liftable front portion to be pivoted up and out of the way when approaching a vertical wall. It also permits the sawhead to continue reworking a joint which extends between surfaces at an angle to one another since the guide discs can remain engaged with the joint so to continue guiding the saw blade.

The sawhead is weighted to keep the support wheels on the pavement and the guide discs and saw blade engaged in the joint. Preferably the link drive is at an angle to the horizontal and extends downwardly from the vehicle to the frame. This arrangement helps to keep the various parts of the sawhead fully engaged with the pavement by pushing on the frame with a vertical force component as well as a horizontal force component. The saw blade preferably cuts up, that is turns clockwise when moving from right to left, to help keep the saw blade from riding up on the cut being made. This further aids maintaining a constant depth of cut.

The use of dual guide discs makes the sawhead self-guiding. The vehicle operator does not steer the sawhead; rather the operator need merely stay reasonably aligned with the expansion joint being reworked. Use of the dual axis joints with the link drive coupling the sawhead frame and the vehicle permits the vehicle to be substantially misaligned with the expansion joint, in one embodiment up to 18", without causing the guides to leave the joint. Therefore, the level of operator skill needs to be less than if exact alignment of the vehicle or separate steering of the sawhead were required.

The dual axis joints each has a generally horizontal, transversely extending axis and a generally vertical axis. The generally horizontal axis at the first dual axis joint permits the sawhead frame to change its relative angular orientation relative to the link to accommodate pavement which is either uneven or changes pitch. Providing another horizontal pivot axis at the second dual axis joint allows the entire sawhead to move vertically, including being lifted off the pavement while still connected to the vehicle.

The sawhead is designed to minimize any variation in depth of cut, especially when the inclination of the pavement surface changes, such as occurs when moving between a flat bottom of a culvert and a sloped culvert side. This is achieved by mounting the support wheels vertically below the axis of the saw blade and by making the diameter of the support wheels relatively small. Placing the support wheels directly below the saw blade axis helps to allow the saw blade to accurately follow the contour of the pavement. The relatively small diameter of the support wheels keeps the axis of the support wheels close to the pavement; this minimizes the reduction in cutting depth which necessarily occurs where the included angle of adjacent surfaces is less than 180 degrees.

Other features and advantages of the invention will appear from the following description in which the preferred embodiment has been set forth in detail in conjunction with the accompanying drawings.

BRIEF DESCRIPTION OF THE PREFERRED EMBODIMENT

Figure 1:
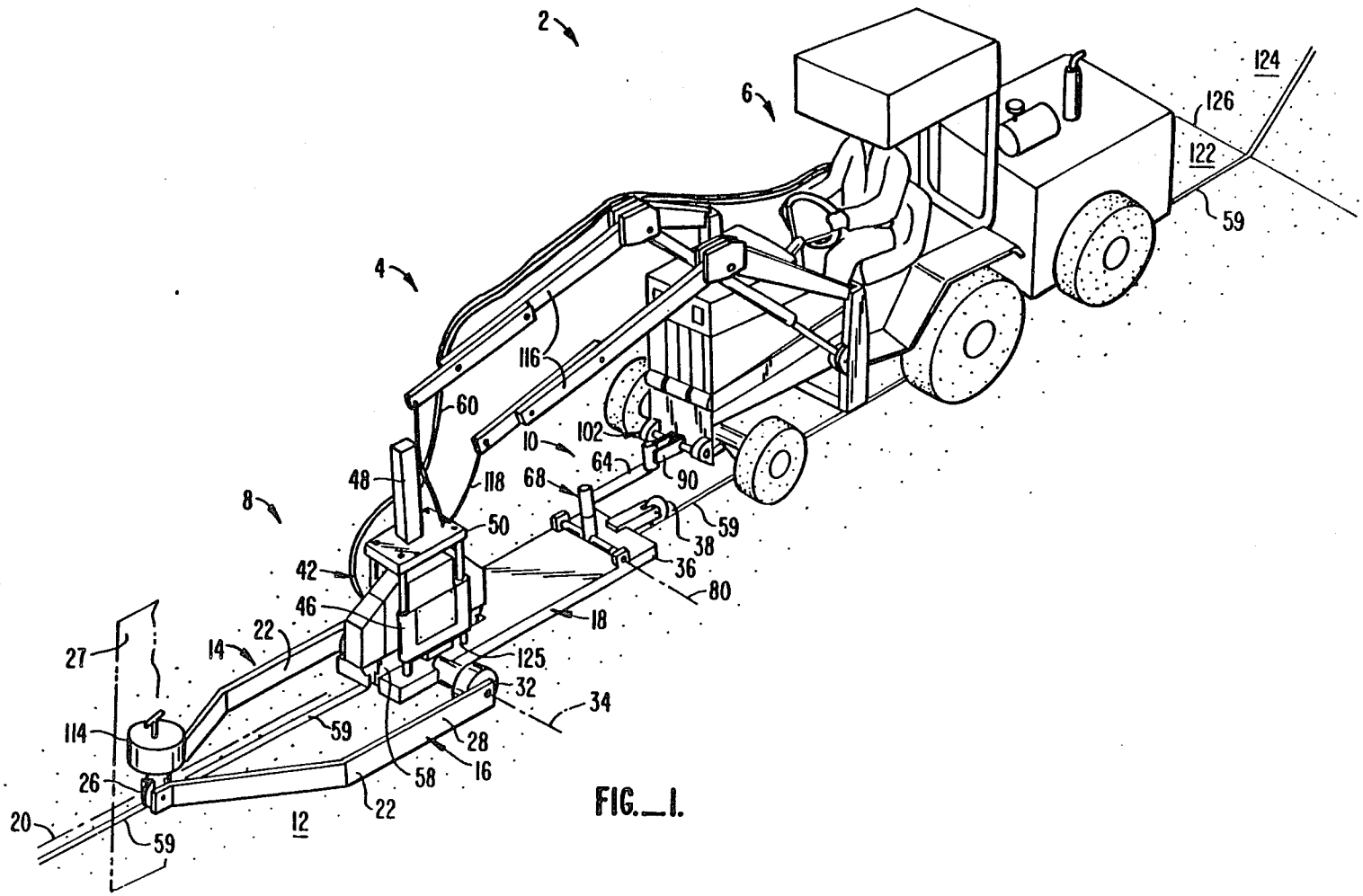
FIG. 1 is an overall perspective view showing the joint reworking apparatus. including a sawhead assembly and a driving vehicle, made according to the invention.

Referring now to FIG. 1. a joint reworking apparatus 2 is shown to include a sawhead assembly 4 and a self-propelled vehicle 6. Sawhead assembly 4 includes a pavement joint reworking sawhead 8 and a link drive 10 by which vehicle 6 pushes, and at times pulls, sawhead 8 over pavement 12.

Figures 2, 2A, 3A, 3B, 4:
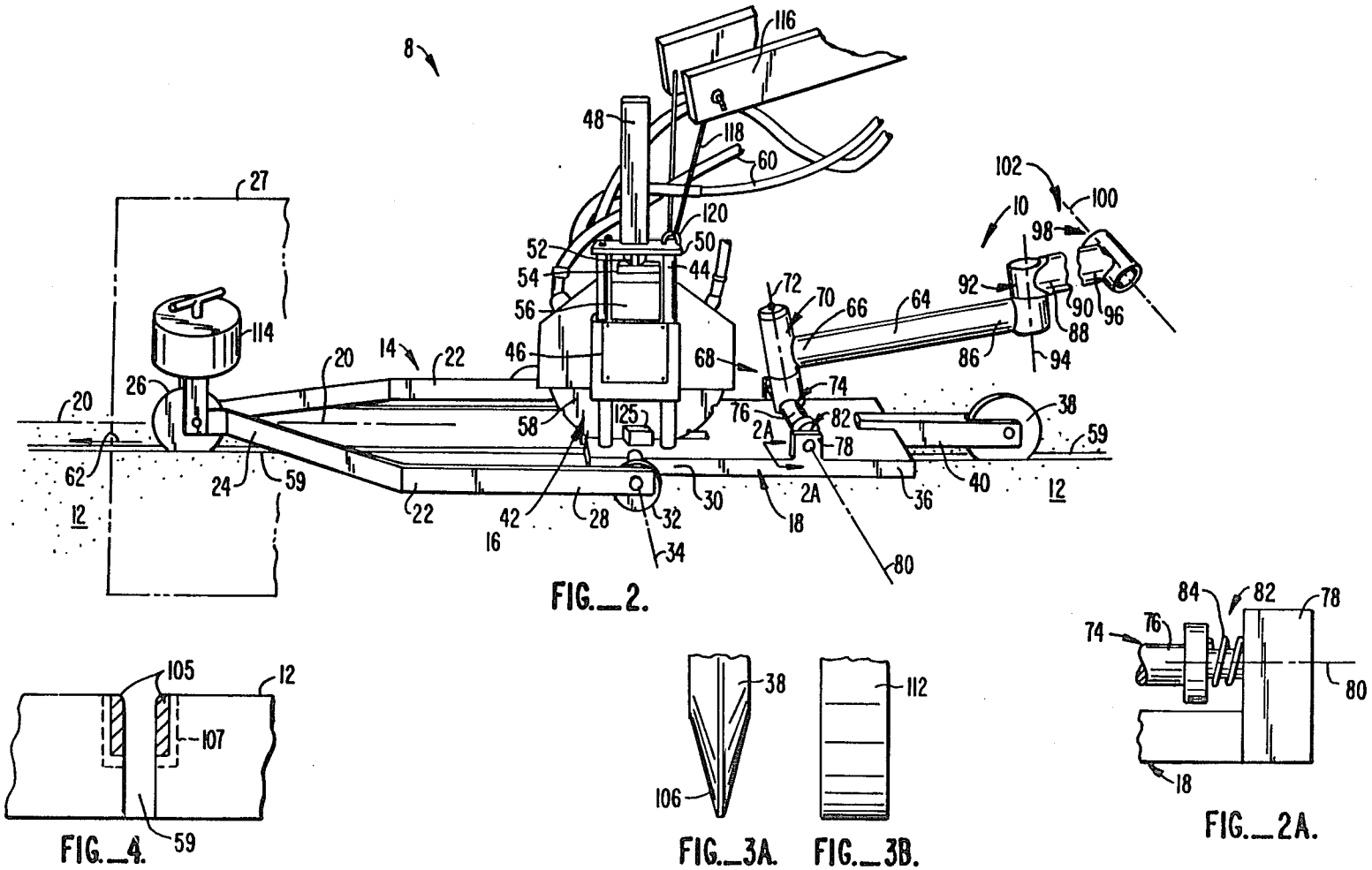
FIG. 2 is a side perspective view of the sawhead assembly of FIG. 1.
FIG. 2A is an enlarged side view of the slip joint taken along line 2A—2A of FIG. 2.
FIGS. 3A and 3B are side views showing the cross-sectional shape of two different guide discs.
FIG. 4 is an end view of a pavement joint.

Referring now also to FIG. 2. sawhead 8 is seen to include a frame 14 having front and rear portions 16, 18 and a longitudinal axis 20. Front portion 16 is generally U-shaped and has a pair of arms 22 extending from a front end 24, at which a guide disk 26 is rotatably mounted. Disk 26 lies in a vertical plane 27 passing through axis 20. The distal ends 28 of arms 22 are pivotally mounted to the forward end 30 of rear portion 18 coaxially with ground support wheels 32 for pivotal movement about a horizontal, transversely extending axis 34. The back end 36 of rear portion 18 is supported by a second guide disk 38 rotatably mounted to a rigid extension 40 of rear portion 18. Disk 38 also lies in vertical plane 27.

A pavement cutting saw 42 is mounted to rear portion 18 directly over axis 34 by four vertical posts 44. Accordingly, guide discs 26, 38 and saw blade 58 are all aligned for engagement with an expansion joint 59 in pavement 12. Saw 42 is movably mounted to posts 44 by a pair of blocks 46, each block 46 engaging a pair of posts 44, and a hydraulic cylinder 48 supported by a plate 50 mounted to the top ends of posts 44. Hydraulic cylinder 48 has a piston rod 52 connected to blocks 46 by connection members 54, 56. Saw 42 is oriented so that saw blade 58 is in vertical plane 27. Saw 42 and hydraulic cylinder 48 are both powered by hydraulic fluid supplied by vehicle 6 through hoses 60.

Sawhead 8 is usually pushed in a forward direction, that is the direction of arrow 62, by vehicle 6 through link drive 10. Link drive 10 includes a first link 64 having a first end 66 pivotally connected to rear portion 18 by a first dual axis joint arrangement 68. Arrangement 68 includes a pivot 70 secured to first end 66 to allow first link 64 to pivot about a first, generally vertical axis 72. Pivot 70 is connected to a pivot 74 including a pivot bar 76 and a pair of pillow blocks 78 secured to rear portion 18 for pivotal movement about a second axis 80. Second axis 80 is generally horizontal and is oriented perpendicular to longitudinal axis 20.

Pivot bar 76 has a pair of slip joints 82, shown in FIG. 2A, at each end adjacent pillow blocks 78. Slip joints 82 each includes a centering spring 84. Slip joints 82 act as lateral load shock absorbers between pivots 70 and 74 while tending to keep pivot 70 in vertical plane 27.

A second end 86 of first link 64 is connected to the first end 88 of a second link 90 by a pivot 92, pivot 92 having a generally vertical third axis 94. Second link 90 has a second end 96 connected to vehicle 6 with pivot 98 having a fourth, horizontal axis 100, the fourth axis oriented generally perpendicular to longitudinal axis 20 when first and second lengths 64, 90 are parallel to axis 20. Together pivots 92, 98 and link 90 constitute a second dual axis joint arrangement 102. Link drive 10 therefore includes first joint arrangement 68, link 64 and second joint arrangement 102.

In reworking expansion joint 59 in pavement 12, initially any existing joint material is preferably removed, at least from the upper portions of joint 59. Apparatus 2 is then used to rework joint 59 so that it may accept the new joint material. Guide disks 26, 38 guide movement of sawhead assembly 4 along pavement 12 so that saw blade 58 remains within joint 104. Guide disks 26, 38 have a tapered outer edge 106, shown in FIG. 3A. This aids proper engagement of discs 26, 38 with an unreworked joint 59 even though joint 59 may have an irregular width and may not be perfectly straight.

Some types of joint sealing materials require that the inside walls of the reworked joint 59 must be smooth and have a relatively close tolerance insofar as width is concerned. To accommodate this, two passes can be made. In the preferred embodiment saw blade 58 makes a first cut 105, shown in FIG. 4. about two inches deep and about one and one-half inches wide. The width of saw blade 58 is then changed and a second cut 107 is made. Second cut 107 has a depth of two and one-quarter inches and a width of one and five-eighths inches. This two-step approach permits the quite accurate sizing of the reworked joint 59 as well as providing very smooth sides and bottom for the reworked joint. During the second pass guide disks 112, shown in FIG. 3B, having a rectangular outer edge can be used to ride within the rectangular first cut 105 made during the first pass. Doing so helps to increase the accuracy of second cut 107 by reducing lateral and vertical movement of guide discs 112 in joint 59.

Saw blade 58 is preferably a set of saw blades separated by spacer discs (not shown). Therefore cut 108 will be several slits in pavement 12. The pavement between the slits can be removed by another pass of apparatus 2 (with modified saw blade spacings) or it can be chipped out. Any roughness at the base of the cut can be removed during second cut 107 by using appropriately positioned saw blades.

Several features combine to keep sawhead 8 engaged with pavement 12 so that action of saw blade 58 does not cause the sawhead to ride up on the pavement. A removable weight 114 is used on front portion 16 of frame 14 to keep guide disk 26 engaged within joint 59. Making rear portion 18 out of a one inch thick plate of steel makes rear portion 18 quite heavy to keep support wheels 32 on pavement 12 and rear guide disk 38 engaged within joint 59. Also, since link drive 10 slopes downwardly from vehicle 6 to sawhead 8, the force exerted by vehicle 6 against sawhead 8 can be resolved into both horizontal and vertical components. Therefore as vehicle 6 pushes sawhead 8 in forward direction 62, sawhead 8 is also pressed against pavement 12. In addition, rotating saw blade 58 clockwise in FIG. 2 helps to keep the saw blade 58 from lifting or riding up while making cuts 108, 110.

The pivotal connection of frame portions 16, 18 allows sawhead 8 to properly track joint 59 even when pavement 12 changes slope. For example, many culverts are made with laterally extending expansion joints 59 extending over the culvert bottom 122 (see FIG. 1) and up their upwardly taping sides 124. These expansion joints can continue onto a horizontal apron at the upper edge of the sloped banks (not shown). The articulated aspect of frame 14 permits guide disks 26, 38 to be continuously engaged within joint 59, or at least engaged for a much longer period of time than would otherwise be possible with a rigid, non-articulating frame, as sawhead 8 passes over the transition area 126 between the two surfaces 122, 124. Also, the articulated frame permits front portion 16 to be pivoted up and out of the way such as when reworking a joint 59 near a vertical wall. (Weight 114 can be removed prior to doing so.)

Positioning the center of the saw blade vertically above axis 34 of wheels 32 allows the vertical height of the center of the saw blade above pavement 12 to remain constant. By using wheels 32 having a relatively small diameter, the wheels more accurately track the actual contour of pavement 12 where two pavement surfaces meet at an angle of less than 180 degrees. such as surfaces 122, 124.

When two adjacent pavement surfaces 122, 124 meet at an angle it is desirable for wheels 32 to move simultaneously from one surface to the other to minimize changing the depth of cut. If expansion joint 59 is not perpendicular to the line of intersection 126 of the two pavement surfaces 122, 124. it may be desirable to temporarily reposition wheels 32 so that both wheels engage the adjacent surface at the same time.

Figure 5:
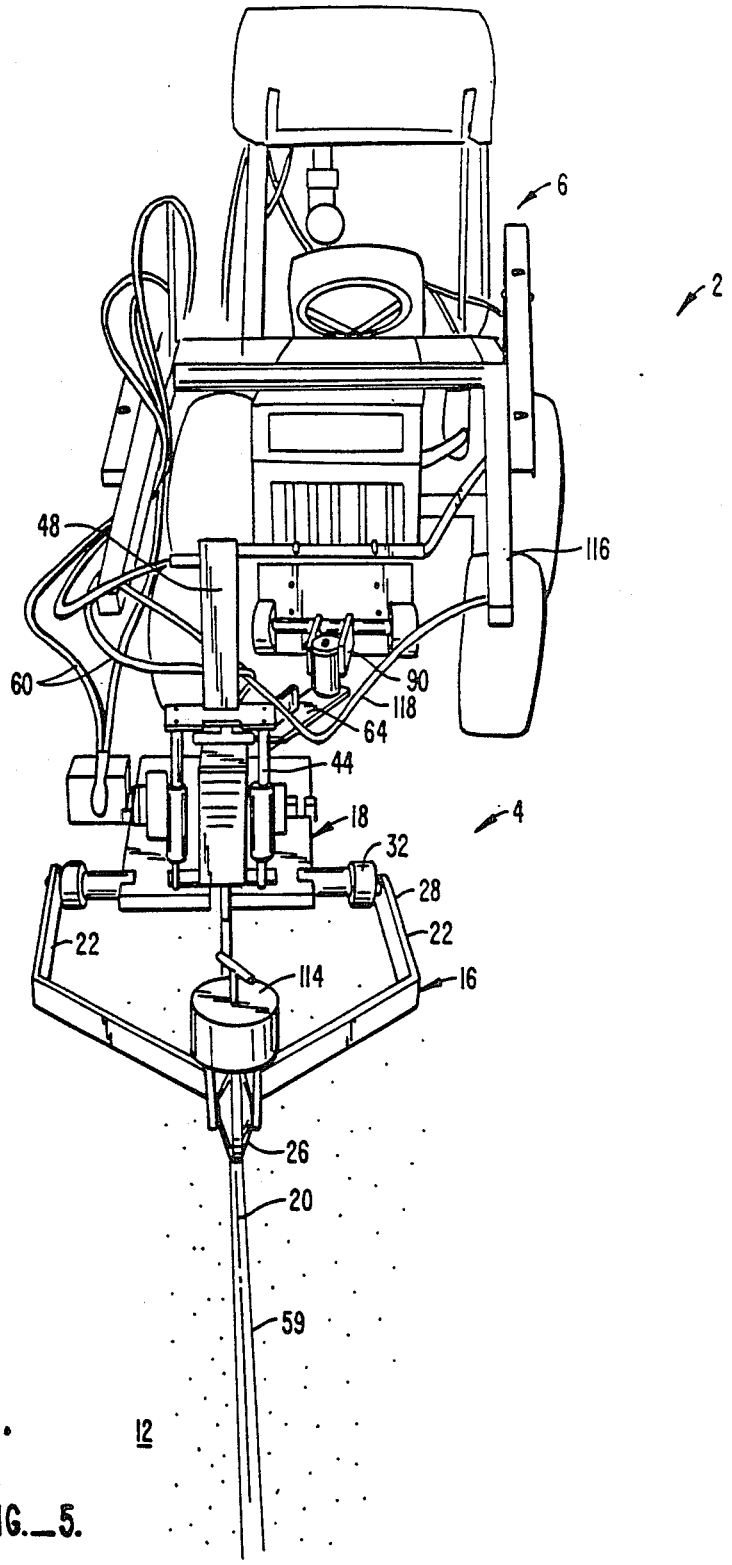
FIG. 5 illustrates the axial misalignment between the sawhead assembly and the vehicle which is compensated in large part by the link drive coupling the sawhead and the vehicle.

Sawhead 8 is lifted up off of pavement 12 by the actuation of a pair of spaced apart lifting arms 116 extending from vehicle 6. A support cable 118, seen best in FIG. 5, is suspended between the outer ends of arms 116. Cable 118 passes through a lift hook 120 mounted to top plate 50. During normal operations with vehicle 6 pushing sawhead 8, booms 116 are lowered sufficiently so that cable 118 is slack allowing sawhead 8 to rest on pavement 12. When arms 116 are raised, sawhead 8 is lifted and link drive 10 articulates about at least horizontal axes 80,100 so that sawhead 8 can be raised without disconnecting link drive 10.

During operation, vehicle 6 can become axially misaligned with joint 59 and longitudinal axis 20. See FIG. 5. However, the configuration of link drive 10. having first and second dual axis joint arrangement 68, 102, accommodates this lateral misalignment without impairing the ability of sawhead 8 to track joint 59. It has been found that longitudinally spacing apart pivots 92, 98 through second link 90 permits a lateral offset of vehicle 6 and sawhead 8 by as much as 18" without affecting tracking. In the preferred embodiment second link 90 is about 12 inches long while first link 64 is about 24 inches long so that the length of the second link is a substantial portion of the length of the first. Other dimensions may also be suitable.

In use, joint 59 first has at least the uppermost portion of any prior joint material removed. The joint material is often a rope-like material and thus can be pulled or pryed up. Alternatively, old joint material can be cut out using a proper type of saw blade 58. Sawhead 8 is lowered by booms 116 so that wheels 32 rest on pavement 12; guide disks 26, 38 are directed into joint 59. Saw 42 is an actuated by appropriate hydraulic lines 60 and saw blade 58 is lowered into joint 59. The depth of cut is limited by spacers 125 positioned between blocks 46 and rear frame portion 18. Vehicle 6 then begins moving, typically pushing, sawhead 8 along joint 59. Sawhead 8 is guided by engagement of guide disks 26, 38 within joint 59. So long as the vehicle operator keeps vehicle 6 reasonably aligned with joint 59. sawhead 8 will track true.

When pavement 12 changes pitch, the articulated nature of frame 14 permits guide disks 26, 38 to remain engaged within joints 59 to a substantial extent. In close quarters front portion 16 can be pivoted up and over saw 42, such as to allow reworking of a joint 59 near a vertical wall. When necessary to move sawhead 8, booms 116 are raised to lift sawhead 8 from pavement 12.

Modification and variation can be made to disclosed the embodiment without departing from the subject of the invention as defined in the following claims. For example, the lower surfaces of frame portions 16, 18 between support wheels 32 and guide disks 26, 38 could be bowed upwardly to create a larger clearance between portions 16, 18 and pavement 12. This may help keep frame 14 from dragging along pavement 12 when sawhead 8 passes over an intersection between pavement surfaces 12 which intersect at an angle greater than 180 degrees. Also, another set of ground engaging wheels 32 could be mounted to rear portion 18 of frame 14 to allow extension 40 to be pivotally secured to back end 36 of rear frame portion 18; this could, under proper circumstances, aid accurate tracking of sawhead 8 along a joint 59 when moving between pavement surfaces at different inclinations.

We claim:

1. A self-guiding sawhead assembly for reworking an expansion joint in a pavement surface comprising:

a frame having a centrally located longitudinal axis, a front portion and a rear portion, the front and rear portions pivotally connected to one another for relative pivotal movement about a pivot axis;

pavement surface engaging support elements mounted to the frame near the pivot axis and spaced apart laterally on both sides of the longitudinal axis;

a powered saw mounted to the frame near the pivot axis, the saw including a pavement cutting saw blade lying in a first vertical plane passing through the longitudinal axis, the pivot axis being perpendicular to said first vertical plane to accommodate pavement surfaces with changing slopes; and front and rear joint engaging guides mounted to the front and rear portions of the frame to lie in the first vertical plane for guiding the frame along the joint so to keep the saw blade engaged with the joint and cause the sawhead assembly to be self-guiding.

2. The sawhead assembly of claim 1 wherein the saw blade is a circular saw blade.

3. The sawhead assembly of claim 1 wherein the front and rear portions each include a supplementary weight for helping to maintain engagement of the front and rear guides in the joint in the pavement surface.

4. The sawhead of claim 1 wherein the pavement surface engaging support elements lie in a second vertical plane defined by the pivot axis.

5. The sawhead assembly of claim 4 wherein the saw blade lies in the second vertical plane so that the ground-engaging support elements, the pivot axis and the saw blade are vertically aligned to help ensure a constant depth of cut when the pavement surface changes inclination.

6. The sawhead assembly of claim 5 wherein the saw blade is a circular saw blade and the support elements are wheels positioned colinear with the pivot axis.

7. The sawhead assembly of claim 1 wherein the pavement surface-engaging support elements are mounted colinear with the pivot axis.

8. The sawhead assembly of claim 1 wherein the pavement surface support elements include first and second wheels rotationally mounted to the rear portion.

9. he sawhead assembly of claim 8 wherein the first and second wheels are mounted colinear with the pivot axis.

10. The sawhead assembly of claim 1 wherein the guides are discs rotationally mounted to the frame.

11. The sawhead assembly of claim 10 wherein the guides narrow in thickness with increasing radius over at least a portion of the radius.

12. The sawhead assembly of claim 1 wherein the saw blade is movably mounted to the frame to adjust the position of the saw blade relative to the pavement surface so to vary the depth of cut of the saw blade into the pavement.

13. The sawhead of claim 12 further comprising means for remotely raising and lowering the saw blade to adjust to the depth of cut.

14. A sawhead assembly for reworking an expansion joint in a concrete surface comprising:

a frame having front and rear ends, a longitudinal axis and front and rear portions pivotally connected to one another for relative pivotal movement about a pivot axis, the pivot axis being perpendicular to a vertical plane passing through the longitudinal axis;

support wheels rotatably mounted to the rear portion of the frame at positions spaced apart laterally on either side of the longitudinal axis:

front and rear concrete joint engaging guide discs rotatably mounted to the front and rear ends of the frame to lie in the vertical plane, the discs having outer portions configured to engage the expansion joint;

a powered saw mounted to the frame, the saw including a pavement cutting saw blade lying in said vertical plane and centered above the support wheels, the saw blade being movably mounted to the frame to change the distance between the saw blade and the concrete surface;

a link drive including a link with one end coupled to the frame by a first dual axis joint arrangement, the link having a second dual axis joint arrangement at its other end, whereby the frame can be pushed through the link drive while the link is other than parallel to the vertical plane without causing the guide discs to disengage from the expansion joint.

15. Pavement expansion joint reworking apparatus comprising:

a self-propelled vehicle;

a self-guiding sawhead for reworking the expansion joint including:

a frame having front and rear ends, a longitudinal axis and front and rear portions pivotally connected io one another for relative pivotal movement about a pivot axis, the pivot axis being perpendicular to a vertical plane passing through the longitudinal axis;

support wheels rotatably mounted to the rear portion of the frame at positions spaced apart laterally on either side of the longitudinal axis;

front and rear expansion joint engaging guide discs rotatably mounted to the front and rear ends of the frame to lie in the vertical plane, the discs having outer portions configured to engage the expansion joint so to guide the frame along the expansion joint; and a powered saw mounted to the frame, the saw including a pavement cutting saw blade lying in said vertical plane and centered above the support wheels, the saw blade being movably mounted to the frame to change the distance between the saw blade and the concrete surface;

a link drive including a link with one end coupled to the frame by a first dual axis joint arrangement, the link having a second dual axis joint arrangement at its other end coupled to the vehicle, whereby the sawhead is pushed through the link drive while the link is other than parallel to the vertical plane without causing the guide discs to disengage from the expansion joint; and a boom, extending from the vehicle and coupled to the sawhead, for selectively lifting and lowering the sawhead.

16. A sawhead assembly for reworking an expansion joint in a pavement surface comprising:

a frame having front and rear ends and a longitudinal axis;

pavement surface engaging support elements mounted to the frame spaced apart laterally on either side of the longitudinal axis;

a powered saw mounted to the frame, the saw including a pavement cutting saw blade lying in a vertical plane passing through the longitudinal axis;

the frame including a front portion and a rear portion pivotally connected to one another for relative pivotal movement about a pivot axis perpendicular to said vertical plane to accommodate pavement surfaces with changing slopes, the front and rear portions each including a supplementary weight for helping to maintain engagement of the front and rear guides in the joint in the pavement surface; and front and rear joint engaging guides mounted to the front and rear ends of the frame to lie in the vertical plane for guiding the frame along the joint so to keep the saw blade engaged with the joint.

17. A sawhead assembly for reworking an expansion joint in a pavement surface comprising:

a frame having front and rear ends and a longitudinal axis;

pavement surface engaging support elements mounted to the frame spaced apart laterally on either side of the longitudinal axis;

a powered saw mounted to the frame, the saw including a pavement cutting saw blade lying in a vertical plane passing through the longitudinal axis;

front and rear joint engaging guides mounted to the front and rear ends of the frame to lie in the vertical plane for guiding the frame along the joint so to keep the saw blade engaged with the joint;

a link drive having first and second links, the first and second links each having first and second ends, the first end of the first link pivotally mounted to the frame at a dual axis first pivot for movement about generally vertical first axis and about a generally horizontal second axis, the second axis being transverse to the vertical plane;

the first end of the second link pivotally coupled to the second end of the first link by a second pivot for movement about a generally vertical third axis; and a third pivot at the second end of the second link having a generally horizontal fourth axis, the fourth axis being transverse to the vertical plane;

whereby the link drive permits pushing the frame with the second link laterally offset from the vertical plane.

18. The sawhead assembly of claim 17, further comprising spring means for laterally positioning the first end of the first link relative to the frame.

19. The sawhead assembly of claim 17 wherein the length of the second link is a substantial portion of the length of the first link.

20. A sawhead assembly for reworking an expansion joint in a pavement surface comprising:

a frame having front and rear ends and a longitudinal axis;

pavement surface engaging support elements mounted to the frame spaced apart laterally on either side of the longitudinal axis;

a powered saw mounted to the frame, the saw including a pavement cutting saw blade lying in a vertical plane passing through the longitudinal axis;

front and rear joint engaging guides mounted to the front and rear ends of the frame to lie in the vertical plane for guiding the frame along the joint so to keep the saw blade engaged with the joint; and a link drive including a link with one end coupled to the frame by a first dual axis joint arrangement, the link having a second dual axis joint arrangement at its other end, whereby the frame can be pushed through the link drive with the link being other than parallel to the vertical plane.

21. The sawhead assembly of claim 20 wherein the first and second joint arrangements each include generally horizontal and generally vertical pivot axes.

22. The sawhead assembly of claim 21 wherein the generally horizontal axes are oriented transverse to the longitudinal axis of the frame.

* * * * *